United States Patent [19]

Mainwaring et al.

[11] 4,415,335

[45] Nov. 15, 1983

[54] COAL PREPARATION

[75] Inventors: David E. Mainwaring; Charles U. Jones, both of Melbourne, Australia

[73] Assignees: B. P. Australia Ltd.; The Broken Hill Proprietary Company Ltd., both of Melbourne, Australia

[21] Appl. No.: 341,981

[22] PCT Filed: May 12, 1981

[86] PCT No.: PCT/AU81/00055

§ 371 Date: Jan. 7, 1982

§ 102(e) Date: Jan. 7, 1982

[87] PCT Pub. No.: WO81/03337

PCT Pub. Date: Nov. 26, 1981

[30] Foreign Application Priority Data

May 13, 1981 [AU] Australia ..... PE 3515

[51] Int. Cl.[3] ..... C10L 9/08; C10L 9/00

[52] U.S. Cl. ..... 44/1 C; 44/24; 241/19; 241/24

[58] Field of Search ..... 44/1 R, 1 C, 1 G, 24; 241/15, 18–20, 24

[56] References Cited

U.S. PATENT DOCUMENTS

| | | | |
|---|---|---|---|
| 1,628,609 | 5/1927 | Newhouse | 241/18 X |
| 1,734,992 | 11/1929 | Barrows | 241/18 X |
| 2,183,924 | 12/1939 | Schoch | 44/1 G |
| 4,209,301 | 6/1980 | Nicol et al. | 44/24 |
| 4,239,496 | 12/1980 | Cochran | 241/18 X |

*Primary Examiner*—Carl F. Dees

[57] ABSTRACT

Deashing of coal is achieved by oil agglomeration and subsequent separation of a carbon oil phase. The oil is removed by steam stripping after the coal oil agglomerates have been disintegrated. The fine coal product can be used in steam generating plants such as power stations.

2 Claims, 2 Drawing Figures

COAL PREPARATION

Figure 1:
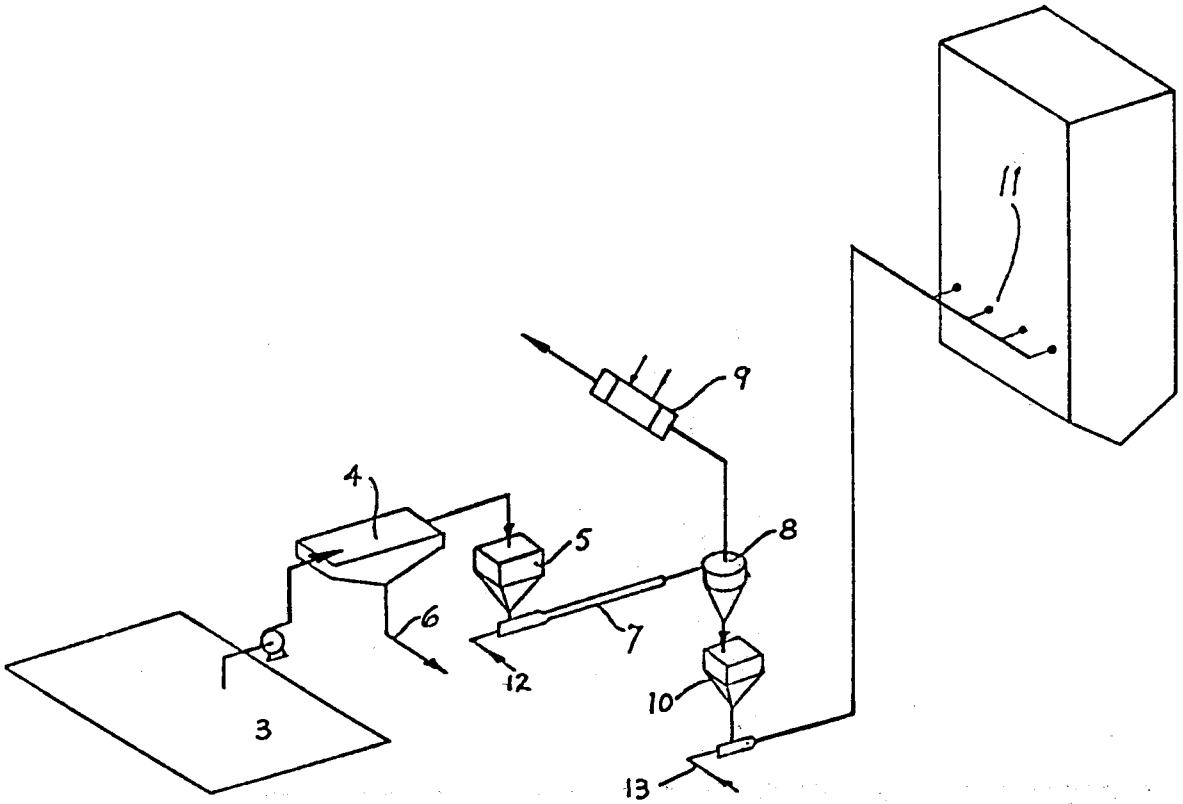

This invention relates to an improved method of preparing mined coal for its end use and in particular to the preparation of mined coal as a feedstock for power generating stations.

Co-pending patent application No. 55574/80 relates to a process of deashing coal which comprises crushing mined coal into small sized particles, subjecting said mined coal to wetting with a hydrocarbon liquid and forming agglomerates of carbonaceous material in said coal, separating said carbonaceous agglomerates from non carbonaceous material present in said coal, subjecting said carbonaceous agglomerates to vapour separation treatment in the absence of oxidizing gases to separate the hydrocarbon liquid from said carbonaceous material to produce the deashed coal product and recycling said hyrocarbon liquid for use in wetting said mined coal.

The content of the disclosure of application No. 55574/80 is incorporated herein by reference.

This prior application was primarily concerned with recovery of oil from agglomerated coal pellets in a fuidized bed in which the integrity of the pellet is retained. This addresses the end use of the product as coke oven feed or similar application in which product handleability is of importance.

In applications within both the coking and steaming coal industries where charging or firing systems handling fine sized material are in use, the disintegration of the agglomerate pellet is necessary at some stage.

Further the residence times required and the heat input required were substantial in the disclosures of the prior patent application.

It is an object of this invention to provide a method in which low residence times are achieved in the steam stripping operation. To this end the present invention provides a method of separating an agglomerated mixture of coal particles and a liquid hydrocarbon to form finely divided coal and recover the hydrocarbon liquid which comprises disintegrating said agglomerates and subsequently and/or simultaneously subjecting agglomerates to vapourphase separation in the presence of steam and in the absence of oxidizing gases to recover the liquid hydrocarbon from the finely divided coal particles.

In a preferred form all of said agglomerates are above 1 mm in size, said steam temperature is above 200° C., the residence time of the coal particles in the steam stripping zone is less than 5 seconds and at least 70% of the coal product comprises particles less than 0.3 mm and final product oil content less than 2.5%.

The exposure of the relatively high specific surface area of the particles after disintegration of the agglomerate pellet during the stripping process in this case offers the potential for the achievement of greatly enhanced heat and mass transfer rates.

Comminution of the agglomerates prior to the vapour phase separation may be carried out in any conventional comminution device. In a preferred method the agglomerates are subjected to initial attrition to reduce the particle size of the agglomerates and subsequently passing said agglomerates into the path of a high velocity stream of steam to further reduce the coal particle size and to separate such hydrocarbon liquid into a vapour phase.

Application of this invention to the use of coal-oil agglomerates offers several advantages over the alternative method of steam stripping in a fluidized bed. Foremost among these is the potentially large reduction in solids hold-up in the stripping system and subsequent improvement of response times due to the reduction in residence time in the steam stripping zone. Much of the complexity of the fluid bed system is removed and control functions are related to steam flow and inlet temperature and pressure alone.

Where the steam is introduced as a jet the velocity and the internal shape of the particle entrainer may be chosen to be sufficient to disintegrate the agglomerates. In this embodiment said agglomerates are passed into a high velocity stream of steam to simultaneously separate the hydrocarbon liquid and to form the finely divided coal particles.

The system at a commercial scale would still utilize underwater storage (tanks or ponds) of the coal-oil agglomeration stage product and the slurry reclamation and de-watering systems as specified in the prior process of No. 55574/80. This feed material would be then fed to the front end of a conveying pipe to which superheated steam would alos be fed. An initial short section of the conveying pipe would be used to achieve disintegration of the feed and the remainder to accomplish removal of the oil from the coal surfaces to the gas stream. Disengagement of the solids from the dry vapours would be achieved in a high efficiency cyclone system with the solids discharging to a storage hopper prior to independent delivery of the fuel to the burners. This then could be performed in lean or dense or phases in steam or air. The cyclone overhead vapours are then totally condensed, and the hydrocarbon liquids separated and returned to the agglomeration system.

Control of the residual oil level of the particulate coal product may be achieved in this system by control of the inlet steam temperature and steam to oil mass ratio both of which strongly influence the kinetics of mass transfer of the oil from the coal surfaces. Further, the product is steam blanketed throughout the stripping and storage systems and no oxidation of the particulate material or spontaneous combustion prior to the burners need be risked.

Integration of the stripper as a conveyor into the boiler control systems of power stations should be more readily achieved with this system than the prior fluid bed system.

In another aspect the present invention provides a method of preparing mined coal for use as fuel in steam generation comprising crushing mined coal into small sized particles subjecting said mined coal to wetting with a hydrocarbon liquid and forming agglomerates of carbonaceous material, separating said carbonaceous material from non carbonaceous material present in said coal and subsequently disintegrating said agglomerates and simultaneously and/or subsequently subjecting the disintegrated agglomerates to a vapour phase separation in the presence of steam and in the absence of oxidizing gases to recover said hydrocarbon liquid and form finely divided coal particles as steam generating fuel.

The method of agglomeration is as described in co-pending application No. 55574/80.

A plant for preparing and delivering fuel to a steam generator comprising a storage for a slurry of crushed, mined coal, apparatus for agglomerating said coal with a hydrocarbon liquid, separation means for separating said coal agglomerates from the water phase of said slurry, comminution apparatus to disintegrate said agglomerates, means to dispense said disintegrated agglomerates into a stripper through which steam is passed at vapour phase separating conditions to vaporize said hydrocarbon liquid from said coal particles, separation apparatus to separate said coal particles and recover said hydrocarbon liquid and means to convey said coal particles to said steam generator. In an alternative embodiment said comminution apparatus is omitted, and the velocity of steam and the internal shape of the particle entrainer which constitutes said stripper is selected to disintegrate said agglomerate.

An example of one configuration of such a system at the pilot plant or commercial scale is shown in FIG. 1. In this scheme unstripped agglomerates are recovered from a storage pond or tank 3 and pumped to a set of dewatering screens 4. Dewatered agglomerates are then fed to a small hopper/feeder 5 at the front end of the stripper and waste water is pumped out through line 6. Agglomerates fed to the stripping tube 7 are picked up by the conveying steam 12 and pass through an initial short length of pipe constructed internally to disintegrate the agglomerate material as it passes through. The remainder of the tube provides the additional residence time for oil vapourisation. Stripped solids then pass with the steam and hydrocarbon vapours to a cyclone 8 where the solids are disengaged. The overhead vapours are then totally condensed in condenser 9, hydrocarbon liquids separated with any coal fines from the water and returned to the agglomeration plant. Solids exit from the cyclone to a surge hopper 10 from which they are then air conveyed by line 13 to the burners 11 of the power generator plant.

The following is set out as an example of a preferred form of the invention.

A sample of coal was treated to the oil agglomeration process as set out in pending application No. 55574/80. The agglomerating oil used was a light gas oil with a boiling range of 240°-340° C. The ash content was reduced from 26% on the feed coal (DCB, dry coal basis), to 13.6% on the agglomerate (DCB).

The particle size of the agglomerates is given in Table 1 and the particle size of the coal particles within the agglomerates is shown in Table 2. The oil and water contents of the agglomerates were 12.3% (total agglomerate basis—TAB) and 4.8% respectively.

TABLE 1

| AGGLOMERATE SIZE | |
|---|---|
| Size mm | % wt. |
| >5.6 | 1.2 |
| 4.75-5.6 | 0.5 |
| 3.35-4.75 | 1.0 |
| 2.36-3.35 | 6.0 |
| 1.7 -2.36 | 26.6 |
| 1.18-1.7 | 37.8 |
| <1.18 | 26.9 |

TABLE 2

| COAL PARTICLE SIZE | |
|---|---|
| Size mm | % wt. |
| >1.7 | 4.8 |
| 0.85 -1.7 | 2.2 |
| 0.425-0.85 | 4.7 |
| 0.212-0.425 | 9.3 |
| 0.106-0.212 | 14.0 |
| 0.53 -0.106 | 16.2 |

TABLE 2-continued

| COAL PARTICLE SIZE | |
|---|---|
| Size mm | % wt. |
| <0.53 | 48.8 |

Figure 2:
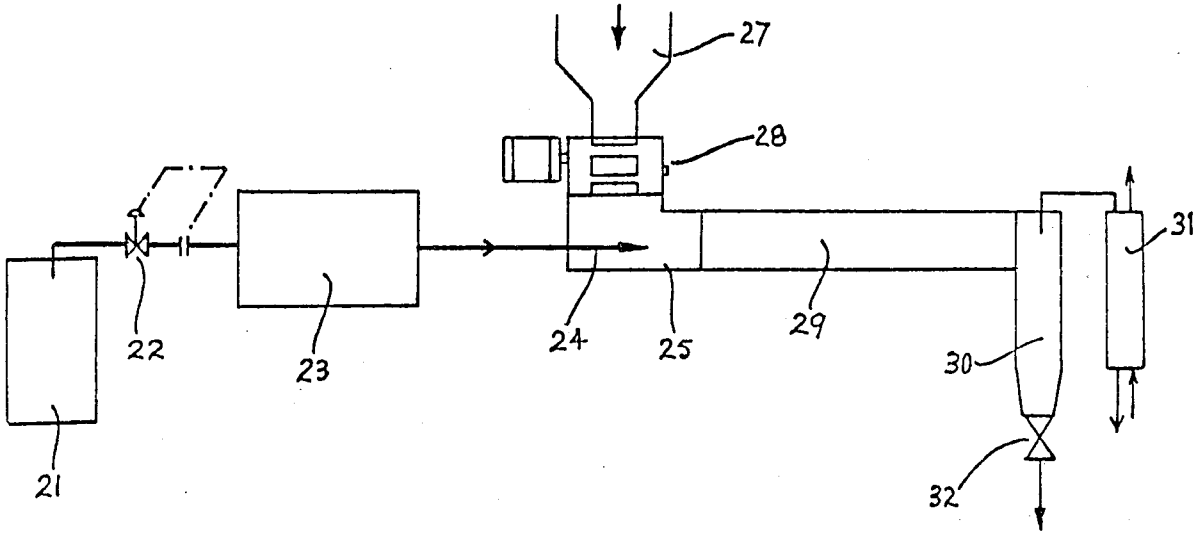

A continuous steam stripping rig was utilized in these examples. The rig is shown in FIG. 2. Saturated steam generated in boiler 21 at 100 psig passes through a pressure reducing valve 22 dropping the pressure into the 0-4 psig range. The steam then passes into a superheater 23 and from the superheater through a jet 24 into an entrainer 25. Agglomerates are also fed from Hopper 27 to the entrainer 25 through a rotary valve 28. Breakdown of the agglomerates occurs under action of the steam jet within the entrainer 25 and the particles are then transported through a carrier pipe 29 of approximately 1 m in length within which oil is vapourized from the agglomerate surface. The stripped solids are separated from the steam and oil in a cyclone 30. The steam and oil are passed through a water cooled condenser 31 from which the oil and water can be separated as distinct liquid phases. The solids are passed through ball valve 32.

Prior to feeding to the steam stripping unit, the agglomerates were part broken up in a rod mill and screened to a top size of 1.18 mm.

Data on processing conditions for four runs carried out on the unit are set out in Table 3. Feed and product size distributions and water and residual oil contents are shown in Table 4.

TABLE 3

| OPERATING CONDITIONS | | | | |
|---|---|---|---|---|
| Run Designation | 1.3.A | 1.3.B | 1.4.C | 1.4.D |
| Steam/Agglomerate Weight Ratio | 4.1 | 1.8 | 1.9 | 0.8 |
| Agglomerate Rate kg/h | 2.7 | 6.0 | 2.2 | 5.4 |
| Estimated Residence Time Sec. (carrier pipe plus cyclone) | 0.45 | 0.45 | 0.8 | 0.8 |
| Temperatures °C. | | | | |
| Steam jet | 370 | 371 | 376 | 375 |
| 11cm from jet | 300 | 287 | 276 | 245 |
| 60cm from jet | 288 | 268 | 236 | 210 |
| 100cm from jet | 288 | 266 | 230 | 195 |
| 140cm from jet | 275 | 258 | 210 | 176 |

TABLE 4

| FEED AND PRODUCT ANALYTICAL DATA | | | | | |
|---|---|---|---|---|---|
| | Water content % TAB | Oil content | Size Distribution <0.3 mm | 0.3-0.6 mm | 0.6-1.18 mm |
| Feed stock 1.3 | 4.8 | 12.3 | 5.4 | 60.9 | 33.7 |
| Product 1.3 A | 0.9 | 0.6 | 80.4 | 13.9 | 5.6 |
| Product 1.3 B | 0.8 | 1.1 | 72.5 | 16.9 | 10.6 |
| Feed Stock 1.4 | 4.8 | 12.3 | 23.1 | 54.7 | 22.2 |
| Product 1.4 C | 0.4 | 1.4 | 93.2 | 6.1 | 0.7 |
| Product 1.4 D | 1.8 | 2.2 | 73.6 | 19.9 | 6.5 |

The data show that a considerable degree of breakdown occurs in the entrainer. Variations to the design geometry of the entrainer will effect the degree of breakdown as will the velocity of steam at the jet. The examples given are indicative of process performance only and should not be taken as limiting the scope of entrainment device claimed in the patent.

Analysis of the data shows that residual oil levels of 0.5 to 2.5% (TAB) may be achieved at residence times of less than 1 second.

As a comparative example, a sample of the total agglomerates of the size shown in Table 1, were stripped using the alternative fluidized bed steam stripping technique disclosed in pending application No. 55574/80. Comparative data are given in Table 5. The data show that comparable oil removal can be achieved using the fast stripping technique in less than 1 second, compared to the 5 minute residence time required when using the fluidized bed technique.

TABLE 5

FAST STRIPPER PERFORMANCE COMPARED TO FLUIDIZED BED

| | Fast stripper Product 1.4 D | Fluidized Bed FBS 2-12 |
|---|---|---|
| Steam/Agglomerate Ratio | 1.8 | 4.0 |
| Residence Time seconds | 0.8 | 300 |
| Temperature °C. | 245-176 (carrier pipe) | 190-170 (fluidized bed) |
| Product | | |
| Total Agglomerate Basis | | |
| Water % wt | 1.8 | 2.4 |
| Oil % wt | 2.2 | 1.7 |

As a further example of the present invention a stripping model was devised which shows the effectiveness of the invention at the higher steam temperatures available at power stations and also treats a much lower particle size range based on complete comminution of the agglomerates. Development of this model for the kinetics of hydrocarbon and water removal from the product of a coal-oil agglomeration process is based primarily on consideration of that product in its disintegrated form. Exposure of the full surface area of the finely ground constituent particles provides potential for heat and mass transfer at greater rates than those obtained experimentally in the fluid bed steam stripping of the primary agglomerate product.

Studies of the structure of agglomerated material with respect to internal voidage and the location of both hydrocarbon and water within the structure has indicated that, (i) hydrocarbon is present in the agglomerate as surface film on coal particles and in interparticle bridges as shown in FIG. 2, (ii) micropores within individual particles are water filled but that this would account for less than 2wt.% water on dry coal basis, (iii) the bulk of the water present occupies a portion of the remaining interparticle voidage not occupied by hydrocarbon.

In translating the relative location of hydrocarbon and water in an agglomerate structure to that obtained on 'instantaneous' disintegration of the original structure, it is reasonable to assume that all hydrocarbon remains as an even surface film on individual particles. Assignment of the location of the water is to a large extent arbitrary and it has been assumed to exist as free droplets on a one to one basis with coal particles at the equivalent bulk water composition. That is, each coal particle in a representative size distribution is associated with a hydrocarbon film, typically 15 wt.%, and a water droplet typically 8 wt%. Although this is an unlikely occurrance in a practical sense it reflects the approximate distribution of water within the original agglomerate structure and the order of magnitude of water surface available for heat and mass transfer. Other forms of drop size distribution are also examined in the model.

Evaporation of hydrocarbon from the films on coal particles and of the water droplets is accomplished by contacting the disintegrated agglomerate material with superheated steam.

The model monitors heat and mass transfer as a function of time thus determining the rates of hydrocarbon stripping from the coal particles, water evaporation and degree of solids heating. Required mass ratios of steam to hydrocarbon and the initial degree of superheat in the steam are predicted.

The physical system represented by the model, with a number of simplifying assumptions, is that of pneumatic conveying of agglomerate material in a steam atmosphere. A number of stages can be identified in the system.

(i) induction of agglomerates at ambient conditions into a conveying pipe, (ii) breakdown of this material to its constituent particles, (iii) movement of the particles down the length of conveying pipe using superheated steam as a carrier, (iv) disengagement of solids from steam and hydrocarbon vapours in a cyclone, (v) total condensation of cycloned vapours to recover hydrocarbon.

The model considers (i) and (ii) to be instantaneous and examines stripping as a function of contact time with steam i.e. operations (iii) and (iv) are included. Condensation is not included in the model.

The stripping model was run with the following input conditions.

(i) agglomerate feed composition: 15 wt.% gas oil and 8 wt.% water on a dry, oil free coal basis, (ii) steam to gas oil ratios of 2 and 3 kg steam/kg gas oil, (iii) steam inlet temperatures of 650° C. and 450° C.

Feed inlet temperatures were taken as 15° C.

Particular size after disintegration ranged from 6 to 100 microns.

An initial run was performed such that total vaporization of both water and gas oil was achieved. The total time required for stripping was 1.67 secs. for a steam/oil ratio of 3 kg/kg and inlet steam temperature of 650° C. Steam and solids at the end of this time were at 138° C.

The results are summarized in Table 6.

TABLE 6

SUMMARY OF RESULTS FOR 15 wt. % GAS OIL, 8 wt. % WATER FEED AGGLOMERATES

| | Fine Droplets 6-55 micron | Coarse Droplets 25-100 micron |
|---|---|---|
| Steam Ratio (Kg steam Kg/oil) | 3.0 | 2.0 |
| Steam Load (Kg steam/Kg dof coal) | 0.45 | 0.30 |
| Inlet Steam Temperature (°C.) | 650 | 450 |
| Stripping times for, (msec). | | |
| 100% water and oil | 1670 | — |
| 100% oil removal | 182 | 212 |
| 0.5% residual oil | 97 | 121 |
| Water vapourisation, at, (wt. %) | | |
| 100% oil removal | 85.4 | 24.0 |
| 0.5% residual oil | 80.0 | 16.7 |
| Fine particle max. temp. (°C.) | 385 | 368 |

These results indicate two points. Firstly, that removal of hydrocarbon oils from the surfaces of coal particles can be achieved in fractions of a second where end use of particulate coal is acceptable. Secondly, that, dependent on the way in which the water present in the structure is dispersed on disintegration of the agglomerate, the potential exists to reduce the steam ratios and temperatures through removal of the hydrocarbon oil before large scale vaporization of water has occurred.

Some of the advantages of the system of this invention over the current method of fluid bed stripping are, (i) in the case of fluid bed stripping residence times of 3-4 minutes requires hold-up of large amounts of material in the bed. Here the hold-up is equivalent to solids content of the lean phase stripper tube, (ii) virtually instantaneous shut-off of the stripper can be achieved by control of the steam flow only, (iii) separation and recovery problems are minimised, (iv) residual oil levels can be controlled via the steam inlet temperture.

Subsequent usage of the de-oiled particulate coal is independent of the stripping system and lean or dense phase conveying to burners may be applied.

The claims defining the invention are as follows:

1. A method of separating an agglomerated mixture of finely divided coal particles and a liquid hydrocarbon to recover the hydrocarbon liquid and the coal as finely divided particles comprising:

providing a conduit having a first end and a second end;

introducing agglomerates of said coal particles and liquid hydrocarbon into said conduit adjacent said first end;

contacing said agglomerates with steam at tempertures in excess of 200° C. to separate the liquid hydrocarbon from its association with said coal particles and to disintegrate said agglomerates into finely divided particles suspended in said steam and entrained liquid hydrocarbon;

passing said separated coal particles and hydrocarbon liquid out of said second end of said conduit within 5 seconds of the steam contacting said agglomerates; and separating sequentially said coal particles and liquid hydrocarbon from said steam.

2. A method as in claim 1 wherein:

all of said agglomerates are above 1 mm. in size;

at least 70 percent of the coal particles comprise particles less than 0.3 mm. in size; and the final product oil content is less than 2.5 percent.

* * * * *